US011370626B1

(12) United States Patent
Mitchell

(10) Patent No.: US 11,370,626 B1
(45) Date of Patent: Jun. 28, 2022

(54) ROLL OF MATERIAL WITH LENGTH INDICATOR

(71) Applicant: Lucy A. Mitchell, Swindon (GB)

(72) Inventor: Lucy A. Mitchell, Swindon (GB)

( * ) Notice: Subject to any disclaimer, the term of this patent is extended or adjusted under 35 U.S.C. 154(b) by 315 days.

(21) Appl. No.: 16/750,295

(22) Filed: Jan. 23, 2020

Related U.S. Application Data

(60) Provisional application No. 62/877,930, filed on Jul. 24, 2019.

(51) Int. Cl.
*B65H 16/00* (2006.01)
*B65D 83/08* (2006.01)

(52) U.S. Cl.
CPC ..... *B65H 16/005* (2013.01); *B65D 83/0805* (2013.01); *B65H 2511/114* (2013.01)

(58) Field of Classification Search
CPC ..... B65H 16/005; B65H 2511/114; B65H 61/00; B65H 2511/512; B65D 83/0805; A47K 10/16
See application file for complete search history.

(56) References Cited

U.S. PATENT DOCUMENTS 1,082,337 A * 12/1913 Kallam ..... B65H 75/18 33/733
1,935,970 A * 11/1933 Wooster ..... A47K 10/02 116/200
4,989,801 A * 2/1991 Thomas ..... B42D 19/00 206/407
6,282,807 B1 * 9/2001 Johnson ..... B65D 83/0841 116/200
6,607,110 B2 * 8/2003 Nusbaum ..... B65D 83/0882 225/18
7,077,073 B2 * 7/2006 Judge ..... A47K 10/16 116/200
9,717,377 B2 * 8/2017 Cattacin ..... A47K 10/16
10,554,025 B2 * 2/2020 Fowler, Jr ..... H02G 1/08
2002/0113162 A1 * 8/2002 Fournier ..... B65H 16/103 242/563.2
2007/0102552 A1 * 5/2007 Gambini ..... B65H 18/28 242/160.1
2011/0114691 A1 * 5/2011 Morinaga ..... G03G 21/1638 226/102
2011/0232560 A1 * 9/2011 King ..... C09J 7/22 116/201
2013/0202837 A1 * 8/2013 Ehara ..... G06K 15/4065 428/41.8
2016/0374522 A1 * 12/2016 Sherrill ..... B65H 35/0073 225/77
2017/0278597 A1 * 9/2017 Houser ..... H01B 13/22
2018/0249870 A1 * 9/2018 Achton ..... A47K 10/3643
2020/0104664 A1 * 4/2020 Feiten ..... G01C 21/20

FOREIGN PATENT DOCUMENTS

DE 102011109327 A1 * 2/2013 ..... B65H 35/0093

* cited by examiner

*Primary Examiner* — Michael E Gallion
(74) *Attorney, Agent, or Firm* — Simpson & Simpson, PLLC

(57) ABSTRACT

A dispenser assembly including a remaining length indicator, comprising a sheet material including an inner end, an outer end, an initial edge, a terminal edge, and an indicator line arranged on the sheet material, and a plurality of markings operatively arranged to engage the indicator line to indicate a length of the sheet material remaining.

17 Claims, 7 Drawing Sheets

ROLL OF MATERIAL WITH LENGTH INDICATOR

CROSS-REFERENCE TO RELATED APPLICATIONS

This application claims the benefit under 35 U.S.C. § 119(e) of U.S. Provisional Application No. 62/877,930, filed Jul. 24, 2019, which application is incorporated herein by reference in its entirety.

FIELD

The present disclosure relates generally to materials dispensed from a roll and, more particularly, to a rolled material and dispenser that indicates the length of material remaining on the roll.

BACKGROUND

Rolled materials are used in a large number of industrial, domestic, and personal applications. Materials such as plastic, paper, metal, and fabric are manufactured in long sheets which are wrapped around a central axis, sometimes occupied by a tube, forming a "roll" of material which can be unrolled to dispense segments of material as needed for use.

There are also dispensers for rolled materials, which are often used to make the unrolling process easier. The dispensers feature a housing unit for the roll of material, with a slot guiding the end of the material sheet as it leaves the housing. Many dispensers make it very difficult for a user to ascertain how much material remains on the roll at any given time. This often leads to a user purchasing a replacement roll before the material is fully used on the first roll, which wastes material.

In addition, even when a material is not contained within a dispenser, or when the dispenser allows a user to observe the roll, it is still difficult to ascertain the amount of material remaining on a roll. The presence or lack of a central tube, the diameter of the tube, and the thickness of the material itself are all factors which make it difficult to estimate the length of material which is still wrapped in a roll.

Currently there are a number of solutions for indicating how much material is remaining on a roll. For example, A physical or mechanical indicator can measure the radius of the cross-section of the rolled material. In another example, a colored line can be printed somewhere near the end of the paper to warn the user that the material is almost fully used.

Some of these solutions attempt to indicate how much material remains on the roll, but these solutions fail to meet the needs of the industry because they require a specific printer and rely on a set inner tube thickness. Specialized printers are expensive, and the colored line(s) can be difficult to read from a distance. Additionally, the colored line only lets the user know the end of the roll is near but gives no indication of exactly how much is left. A user might therefore change the roll immediately, wasting a percentage of material on a roll.

Other solutions attempt to give a warning of when to change a roll of material, but these solutions are similarly unable to meet the needs of the industry because they do not give an exact amount of paper remaining and lack accuracy.

Other rolls simply have no method to indicate the end of the roll, which inconveniences the users who run out of material without warning in middle of use.

Thus, there has been a long-felt need for a device and/or method that accurately indicates the exact amount of material remaining on a roll, without requiring a specialized printer.

SUMMARY

According to aspects illustrated herein, there is provided a dispenser assembly including a remaining length indicator, comprising a sheet material including an inner end, an outer end, an initial edge, a terminal edge, and an indicator line arranged on the sheet material, and a plurality of markings operatively arranged to engage the indicator line to indicate a length of the sheet material remaining.

According to aspects illustrated herein, there is provided a dispenser assembly, comprising a housing including a slot, a sheet material at least partially arranged in the housing, the sheet material including an inner end, an outer end, an initial edge, a terminal edge, and an indicator line arranged on the sheet material, wherein the sheet material is operatively arranged to be removed from the housing through the slot, and a plurality of markings operatively arranged proximate the slot to engage the indicator line to indicate a length of the sheet material remaining in the housing.

According to aspects illustrated herein, there is provided a dispenser assembly, comprising a housing including a slot, a sheet material at least partially arranged in the housing, the sheet material including an inner end connected to a tube, an outer end, an initial edge, a terminal edge, and an indicator line arranged diagonally on the sheet material, wherein the sheet material is wrapped around the tube to form a roll, and operatively arranged to be removed from the housing through the slot, and a plurality of marking operatively arranged proximate the slot to engage the indicator line to indicate a length of the sheet material remaining in the housing.

The present disclosure generally comprises a sheet material with an inner end, an outer end, an initial edge, and a terminal edge; a center axis, wherein the sheet material is wrapped about the center axis such that a cross-section of the rolled material shows a spiral of material with the center axis positioned in the center of the spiral, and a diagonal line emanating from a corner formed where the inner end of the sheet material meets the initial edge of the sheet material.

Included in this disclosure is a specially marked roll of material with a diagonal line from one side of the paper to the other, and an existing dispenser used to dispense material from a roll. The dispenser includes a slot which allows the material to exit the dispenser, and it can also include a set of markings corresponding to the length of the diagonal line on the material. These components are used in conjunction with each other to accurately indicate the exact amount of material left on the roll.

The markings on the slot where the paper or other material exits could be on a removable piece of tape that adheres to the housing of the dispenser, near the slot. This would enable the user to change the length of the diagonal line to give variable unit length indication to the end of the roll of material.

The diagonal line can be a different color than the material to highlight it, and, in the case of material for printing (e.g., receipt paper), the diagonal line should be fainter than the lettering intended to be printed on the paper or material so the printed material can still be read easily.

The disclosed device does not rely on any special printer to indicate how much material is remaining on a roll. The colored diagonal line is easily seen and very accurate. The combination of diagonal line and numbers on the printer slot provides a simple, accurate, and elegant solution that draws the attention to the user that the paper is running low. It should be appreciated that the diagonal line and numbers are functionally related to the substrate upon which they are printed in that they provide a visual indication of the material remaining on the roll.

It is an object of the present disclosure to provide a dispenser or printer that can accurately indicate how much material is remaining as it dispenses or prints and uses up the roll of material, but which doesn't require a new expensive printer or dispenser.

Furthermore, it is another object of the present disclosure to provide a material length indicator that will work with any printer or dispenser regardless of manufacturer, without increasing the cost.

It is another object of the present disclosure to provide a length indicator that can be adjusted to indicate any length remaining and will work on any material.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1A:
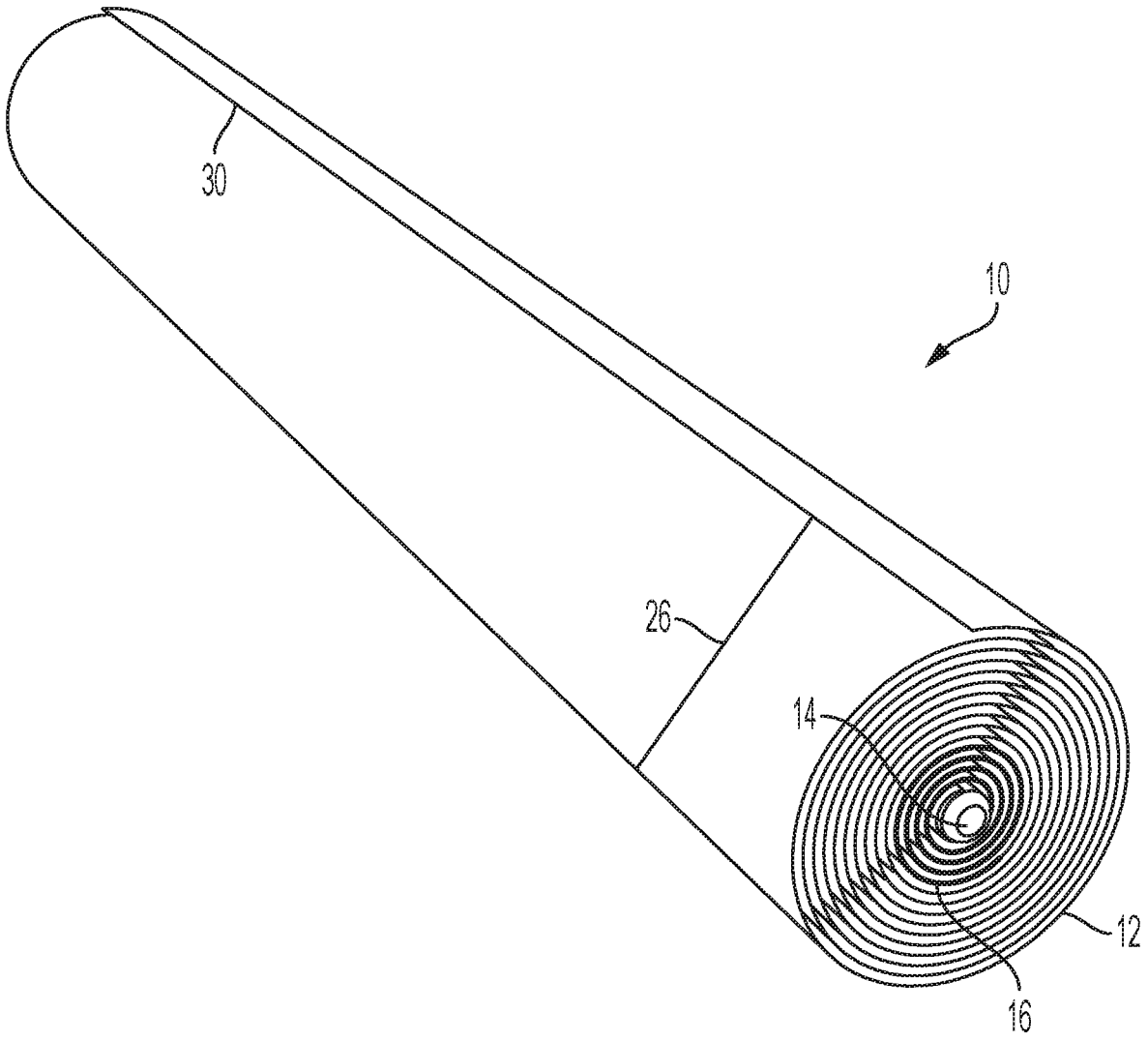
FIG. 1A shows a perspective view of a roll of material with a tube in the center and a sheet material wrapped about the tube.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, pneumatics, and/or springs.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

By "non-rotatably connected" elements, we mean that: the elements are connected so that whenever one of the elements rotate, all the elements rotate; and relative rotation between the elements is not possible. Radial and/or axial movement of non-rotatably connected elements with respect to each other is possible, but not required. By "rotatably connected" elements, we mean that elements are rotatable with respect to each other.

Figure 1B:
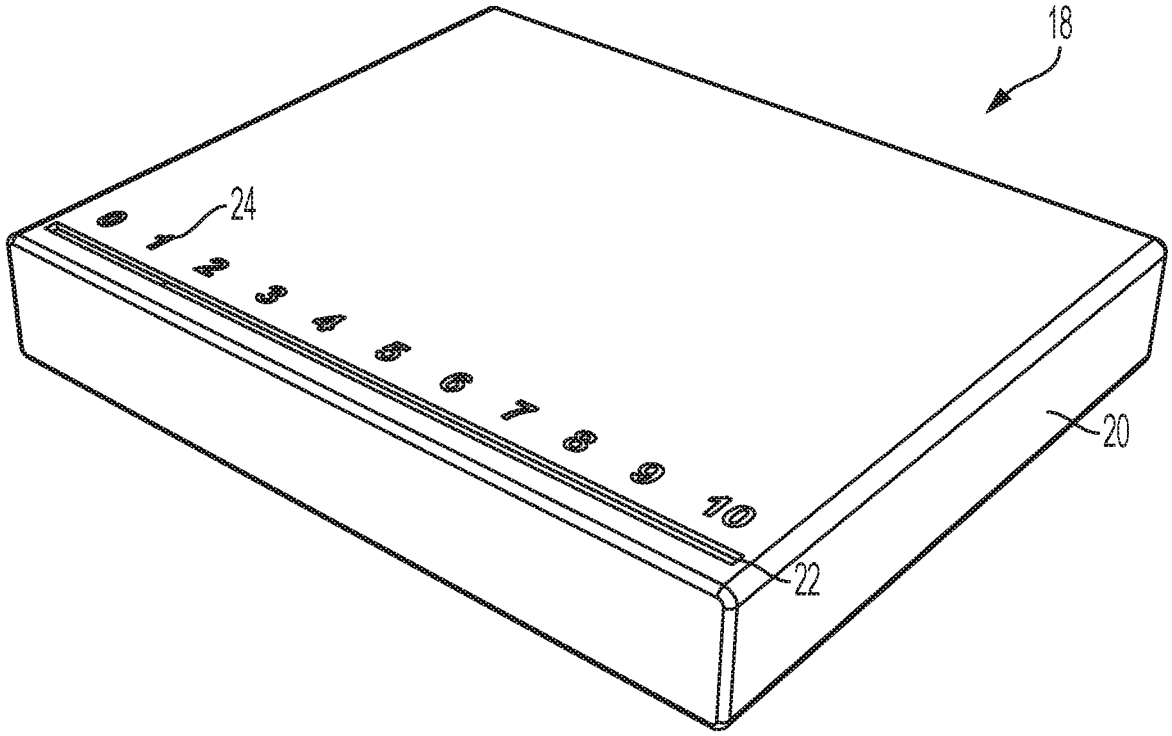
FIG. 1B shows a perspective view of a dispenser with numerical markings arranged along a slot therein.

Adverting now to the figures, FIG. 1A shows a perspective view of roll 10. FIG. 1B shows a perspective view of dispenser 18. The following description should be read in view of FIGS. 1A-B.

Roll 10 includes sheet material 12 and tube 14. Sheet material 12 includes inner end 28 (see FIG. 3B), outer end 30, initial edge 32 and terminal edge 34. Initial edge 32 and terminal edge 34 are parallel to each other and perpendicular to the inner end 28 and outer end 30. Sheet material 12 may comprise any length suitable for the particular application it is being used for. In some embodiments, sheet material 12 includes diagonal indicator line 26 arranged thereon. Diagonal indicator line 26 may be imposed on sheet material 12 via any suitable means, including but not limited to, stamping, laser etching, ink printing, toner printing, burning, etching, carving, affixing a separate substrate onto the sheet material 12 (e.g., adhering), watermarking, etc. Diagonal indicator line 26 can be colored for further clarity be in grayscale. Diagonal indicator line 26 is arranged generally diagonally from proximate the corner of sheet material 12 formed by outer end 30 and initial edge 32 to proximate the corner of sheet material 12 formed by inner end 28 and terminal edge 34. In some embodiments, diagonal indicator line 26 travels a predetermined length diagonally along the sheet material 12, spanning sheet material 12 and terminating at a predetermined location at or proximate to terminal edge 34.

Dispenser 18 is operatively arranged to dispense sheet material 12. Dispenser 18 comprises housing 20 operatively arranged to hold roll 10 such that sheet material 12 is rotatable therein. Dispenser 18 further comprises slot 22 arranged to engage sheet material 12. In some embodiments, tube 14 is rotatably connected to housing 20 and rotates as sheet material 12 is being displaced through slot 22. Sheet material 12 is removed from dispenser 18 through slot 22 thereby separating from tube 14.

Dispenser further comprises markings 24. In some embodiments, markings 24 are arranged on housing 20 proximate slot 22. Markings 24 correspond to the remaining length of sheet material 12. Specifically, markings 24 are operatively arranged to align with diagonal indicator line 26 to indicate how much more sheet material 12 is left within dispenser 18. In some embodiments, markings 24 are numerical numbers. It should be appreciated, however, that markings 24 include any symbol, letter, or number suitable to adequately indicate to a user how much sheet material 12 is remaining within dispenser 18 (i.e., the remainder of roll 10). In some embodiments, and as shown, the length of the sheet material 12 is 10 units. The numerical markings (24) count down from 10 to 0 units, with 10 corresponding to a substantially full roll 10 (i.e., no sheet material 12 has been removed from roll 10) and 0 corresponding to a substantially empty roll 10 (i.e., little to no sheet material 12 remains on roll 10). Markings 24 are arranged to correspond to the position of the intersection-point of diagonal indicator line 26 and slot 22, in order to indicate a length measurement for sheet material 12 remaining on roll 10. This will be discussed in greater detail below.

Figure 2A:
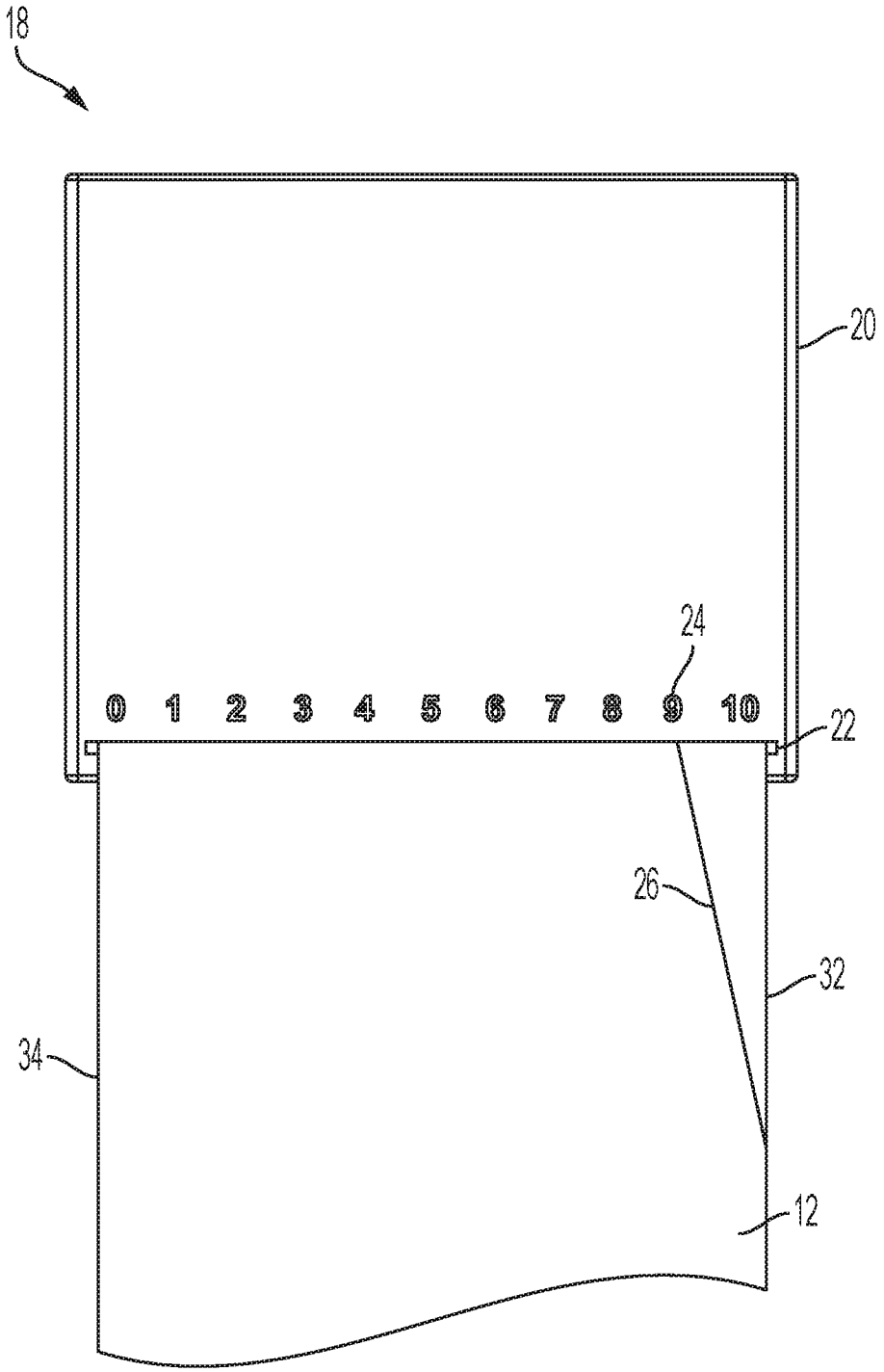
FIG. 2A shows a top elevational view of the roll of material assembled with the dispenser, according to an embodiment of the present disclosure.

FIG. 2A shows a top elevational view of roll 10 assembled with dispenser 18, according to an embodiment of the present disclosure. Sheet material 12 is contained within housing 20 and sheet material 12 is passed through slot 22 of dispenser 18. As sheet material 12 is used (i.e., as sheet material 12 is unrolled from tube 14), diagonal indicator line 26 is or becomes visible. As material 12 unrolls, exposing more of the material's length, the point where diagonal line 26 intersects slot 22 will travel away from initial edge 32 toward terminal edge 34. In the embodiment shown, numerical markings 24 are shown on dispenser 18, near slot 22. For example, markings 24 comprise units 0-10, and FIG. 2A shows diagonal indicator line 26 intersecting the unit "9" marking 24. This indicates to the user that there are nine units of length of sheet material 12 remaining on roll 10.

Figure 2B:
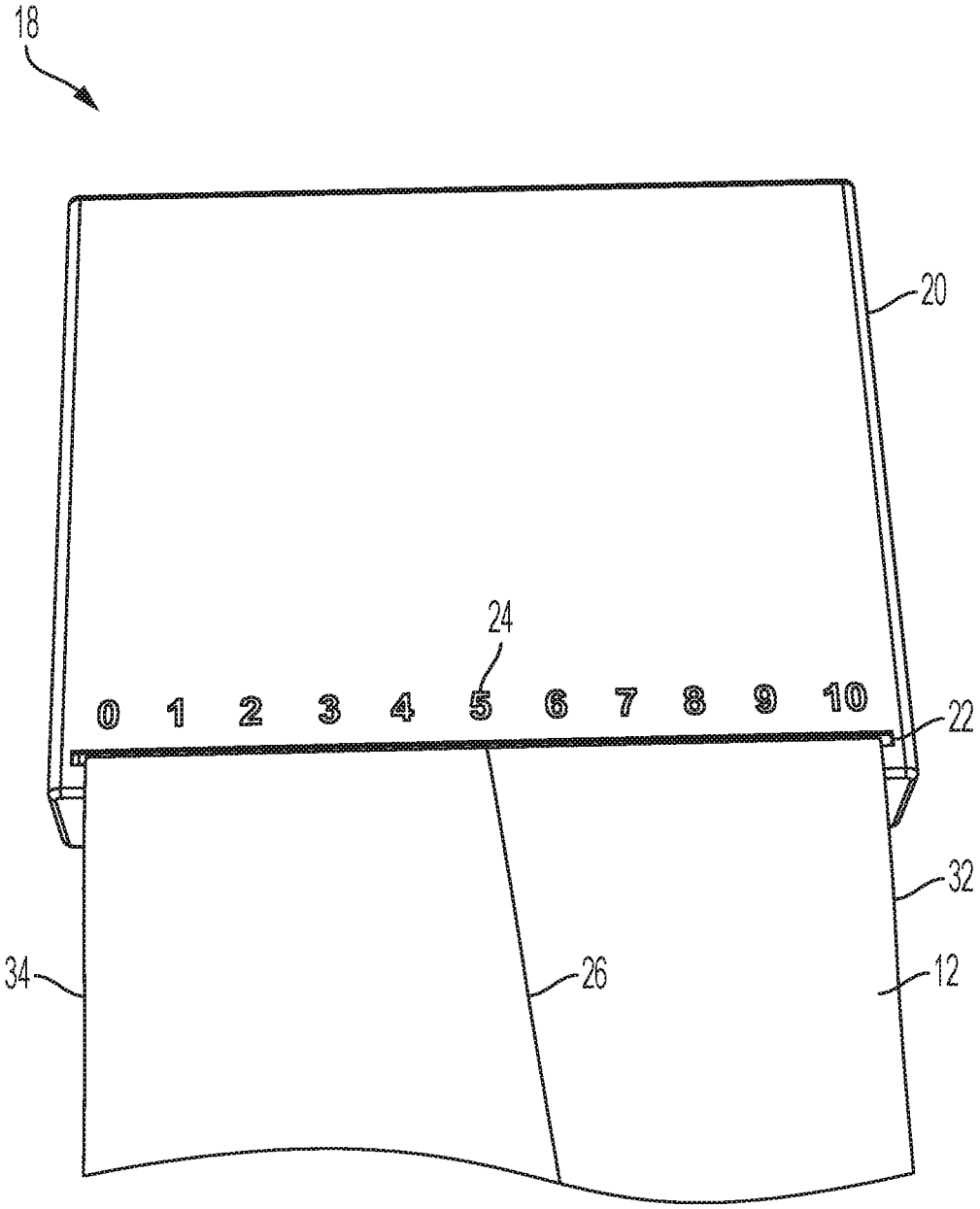
FIG. 2B shows a top perspective view of the roll of material assembled with the dispenser as shown in FIG. 2A.

FIG. 2B shows a top perspective view of roll 10 assembled with dispenser 18. As sheet material 12 continues to be used (i.e., removed from dispenser 18), the point at which diagonal indicator line 26 intersects slot 22 moves further toward the lower numerical markings 24. For example, as shown in FIG. 2B, diagonal indicator line 26 indicates that there are now five units of length of sheet material remaining on roll 10, which of course is less than the nine units of length of sheet material 12 on roll 10 shown in FIG. 2A.

Figure 2C:
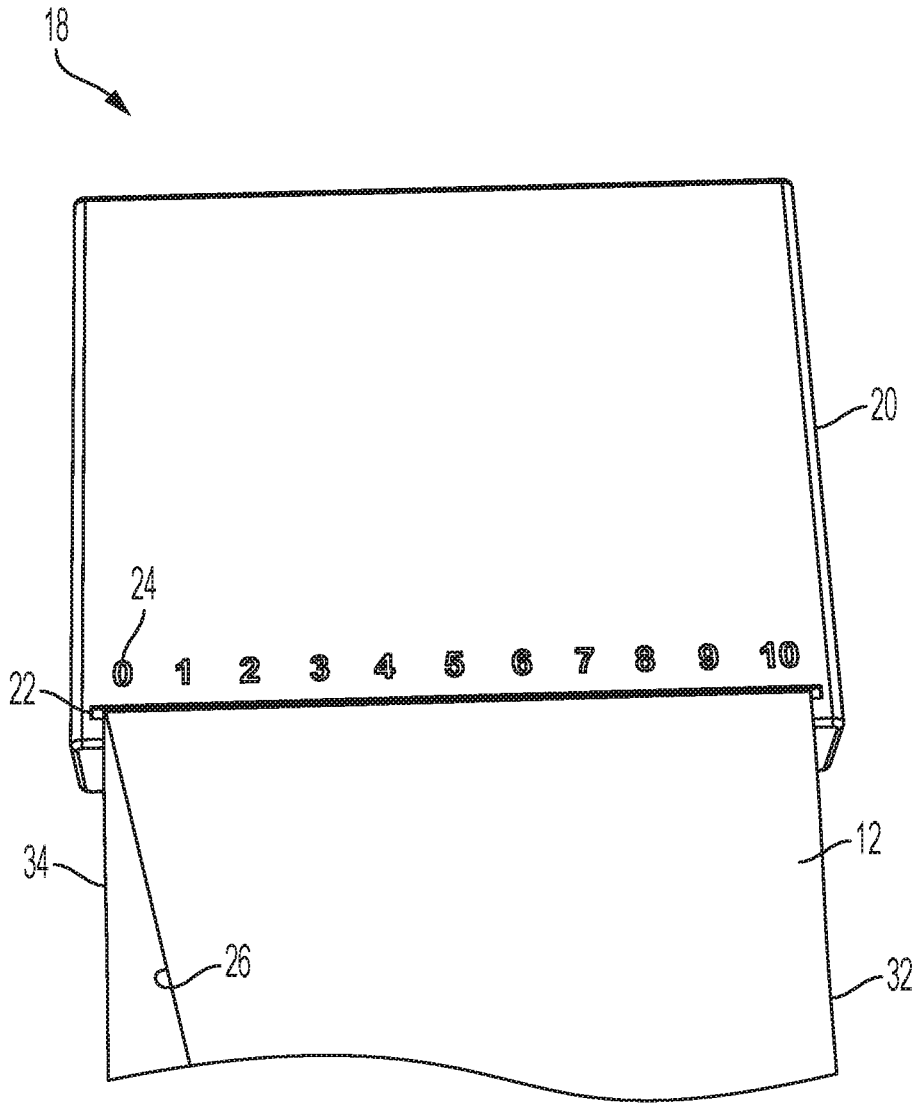
FIG. 2C shows a top perspective view of the roll of material assembled with the dispenser as shown in FIGS. 2A-B.

FIG. 2C shows a top perspective view of roll 10 assembled with dispenser 18. Roll 10 is now completely (or substantially) unrolled. The point where diagonal indicator line 26 intersects with slot 22 indicates the unit "0" marking 24. This indicates that there are zero units of length of sheet material 12 remaining on roll 10, which of course is less than the five units of length of sheet material 12 on roll 10 shown in FIG. 2B.

Figure 3:
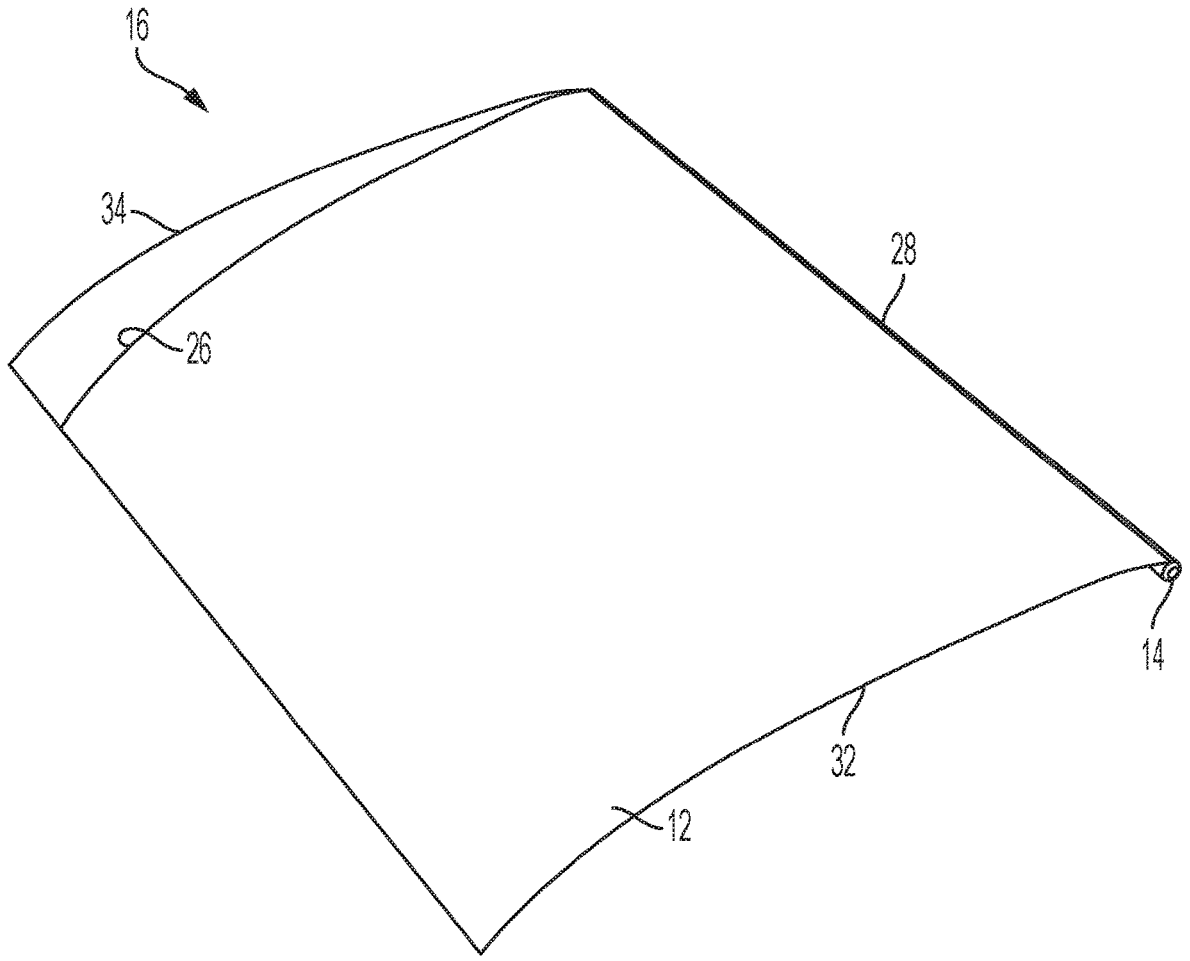
FIG. 3 is a perspective view of a section of the sheet material which includes the inner end from which the diagonal line indicator emanates; and, FIG. 4 shows a top elevational view of a roll of material assembled with the dispenser, according to an embodiment of the present disclosure.

FIG. 3 is a perspective view of a section of sheet material 12, or innermost portion 16. FIG. 3 shows sheet material 12, after it has been completely unrolled from roll 10 and/or tube 14, outside of dispenser 18. The very last length of sheet material 12 terminates at inner end 28 and includes the corner from which diagonal indicator line 26 emanates (i.e., the corner formed by terminal edge 34 and inner end 28). In some embodiments, inner end 28 is connected to tube 14 via any suitable method (e.g., adhesive, rivets, bolts, nails, screws, solder, welding, etc.).

Markings 24 may correspond to specific units of measurement such as meters, feet, inches, centimeters, etc. For a given unit indication between markings 24 on dispenser 18, there should be a corresponding length of sheet material 12 that passes through slot 22. As the unit length of sheet material 12 (e.g., one foot of sheet material 12) passes through slot 22, the point where diagonal indicator line 26 intersects with slot 22 will show a corresponding movement (i.e., the intersection-point moves one unit). Thus, the intersection-point of diagonal indicator line 26 will move one unit between markings 24 for every one unit of length that passes through slot 22. This is just an example of how the system of the present disclosure may work.

In some embodiments, the predetermined length, in units, of the termination of diagonal indicator line 26 will correspond to the units used for marking dispenser 18. For example, if dispenser 18 includes markings 24 for units 0-10, diagonal indicator line 26 should extend from inner end 28, corresponding to the unit "0" length indicator (i.e., proximate terminal edge 34), to terminate at a ten-unit distance, corresponding the unit "10" length indicator (i.e., proximate initial edge 32). As such, diagonal indicator line 26 will begin to appear at a ten-unit length before outer end 30 of sheet material 12 is removed from slot 22, and will continue to indicate the length of sheet material 12 remaining until roll 10 is completely unrolled or empty.

It should be appreciated that diagonal indicator line 26 can be printed in either direction, for any unit of length measurement, and for any length of sheet material 12. For example, if only a six-foot warning is needed, diagonal indicator line 26 can be printed on the last six feet of roll 10 only, and markings 24 including numbers from 0-6 will be arranged on dispenser 18 proximate slot 22.

Figure 4:
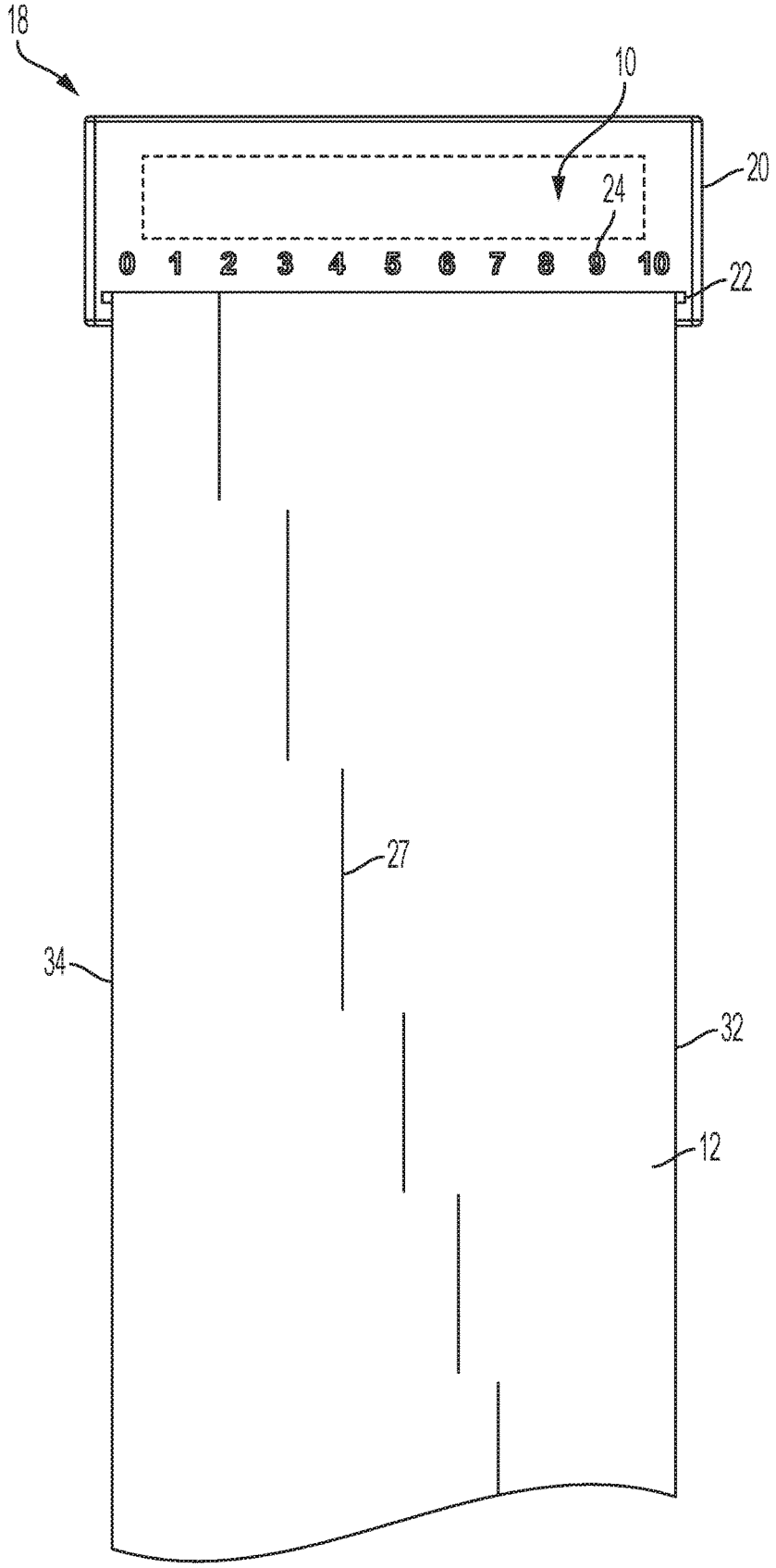

FIG. 4 shows a top elevational view of roll 10 of sheet material 12 assembled with dispenser 18, according to an embodiment of the present disclosure. In the embodiment shown, sheet material 12 includes stepped indicator line(s) 27 arranged thereon. Stepped indicator line 27 may be imposed on sheet material 12 via any suitable means, including but not limited to, stamping, laser etching, ink printing, toner printing, burning, etching, carving, affixing a separate substrate onto the sheet material 12 (e.g., adhering), watermarking, etc. Stepped indicator line 27 can be colored for further clarity be in grayscale. Stepped indicator line 27 is arranged generally in a diagonal fashion from proximate the corner of sheet material 12 formed by outer end 30 and initial edge 32 to proximate the corner of sheet material 12 formed by inner end 28 and terminal edge 34. In some embodiments, stepped indicator line 27 travels a predetermined length diagonally along the sheet material 12, spanning sheet material 12 and terminating at a predetermined location at or proximate to terminal edge 34. In the embodiment shown, each stepped portion of stepped indicator line 27 indicates approximately how much length of sheet material 12 remains on roll 10. For example, as shown in FIG. 4, the portion of stepped indicator line 27 intersecting with slot 22 is the unit "2" marking 24, thereby meaning there is approximately two units of length of sheet material 12 left on roll 10.

In some embodiments, dispenser 18 can be a printer, a tear-off dispenser, a receipt dispenser, a label maker, an adhesive tape gun, or any other form of dispenser which is known to those with ordinary skill in the art. It should be appreciated that known dispensers may be fitted with numerals and the roll of the present disclosure.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

10 Roll
12 Sheet material
14 Tube
16 Innermost portion
18 Dispenser
20 Housing
22 Slot
24 Markings
26 Diagonal indicator line
27 Stepped indicator line
28 Inner end
30 Outer end
32 Initial edge
34 Terminal edge

What is claimed is:

1. A dispenser assembly including a remaining length indicator, comprising:
- a sheet material including:
  - an inner end;
  - an outer end, wherein a length of the sheet material runs from the inner end to the outer end;
  - an initial edge;
  - a terminal edge; and,
  - an indicator line arranged on the sheet material, wherein the indicator line includes a plurality of stepped lines, the plurality of stepped lines travel from the initial edge towards the terminal edge; and,
- a plurality of markings operatively arranged to engage the indicator line to indicate a length of the sheet material remaining.

2. The dispenser assembly as recited in claim 1, wherein the sheet material forms a roll.

3. The dispenser assembly as recited in claim 2, wherein the inner end is connected to a tube and the sheet material is wrapped around the tube to form the roll.

4. The dispenser assembly as recited in claim 1, wherein the indicator line is arranged diagonally on the sheet material.

5. The dispenser assembly as recited in claim 4, wherein the indicator line extends from proximate a first corner of the sheet material formed by the initial edge and the outer end to a second corner of the sheet material formed by the terminal edge and the inner end.

6. The dispenser assembly as recited in claim 1, wherein each marking of the plurality of markings corresponds to the length of the sheet material.

7. The dispenser assembly as recited in claim 1, further comprising a housing including a slot, wherein the sheet material is arranged within the housing.

8. The dispenser assembly as recited in claim 7, wherein the sheet material is withdrawn from the housing through the slot.

9. The dispenser assembly as recited in claim 8, wherein the plurality of markings are arranged proximate the slot.

10. The dispenser assembly as recited in claim 1, wherein the plurality of stepped lines are arranged parallel to the initial edge.

11. A dispenser assembly, comprising:
- a housing including a slot;
- a sheet material at least partially arranged in the housing, the sheet material including:
  - an inner end;
  - an outer end, wherein a length of the sheet material runs from the inner end to the outer end;
  - an initial edge;
  - a terminal edge; and,
  - an indicator line arranged on the sheet material, wherein the sheet material is operatively arranged to be removed from the housing through the slot, wherein the indicator line includes a plurality of stepped lines, the plurality of stepped lines travel from the initial edge towards the terminal edge; and,
- a plurality of markings operatively arranged proximate the slot to engage the indicator line to indicate a length of the sheet material remaining in the housing.

12. The dispenser assembly as recited in claim 11, wherein the sheet material forms a roll.

13. The dispenser assembly as recited in claim 12, wherein the inner end is connected to a tube and the sheet material is wrapped around the tube to form a roll.

14. The dispenser assembly as recited in claim 11, wherein the indicator line is arranged diagonally on the sheet material.

15. The dispenser assembly as recited in claim 14, wherein the indicator line extends from proximate a first corner of the sheet material formed by the initial edge and the outer end to a second corner of the sheet material formed by the terminal edge and the inner end.

16. The dispenser assembly as recited in claim 11, wherein each marking of the plurality of markings corresponds to the length of the sheet material.

17. A dispenser assembly, comprising:

a housing including a slot;

a sheet material at least partially arranged in the housing, the sheet material including:

an inner end connected to a tube;

an outer end, wherein a length of the sheet material runs from the inner end to the outer end;

an initial edge;

a terminal edge; and, an indicator line arranged diagonally on the sheet material, wherein the indicator line includes a plurality of stepped lines, the plurality of stepped lines travel from the initial edge towards the terminal edge, wherein the sheet material is:

wrapped around the tube to form a roll; and, operatively arranged to be removed from the housing through the slot; and, a plurality of marking operatively arranged proximate the slot to engage the indicator line to indicate a length of the sheet material remaining in the housing.

* * * * *